United States Patent [19]

Chabot, Jr.

[11] Patent Number: 4,945,866

[45] Date of Patent: Aug. 7, 1990

[54] ALTERED PISTON TIMING ENGINE

[76] Inventor: Bertin R. Chabot, Jr., 2331 Blue Ridge Ave., Menlo Park, Calif. 94025

[21] Appl. No.: 282,964

[22] Filed: Dec. 5, 1988

Related U.S. Application Data

[63] Continuation of Ser. No. 31,475, Mar. 26, 1987, abandoned.

[51] Int. Cl.[5] ..... F02B 75/26

[52] U.S. Cl. ..... 123/54 R; 123/58 R

[58] Field of Search ..... 123/48 B, 78 BA, 78 E, 123/78 R, 78 B, 51 BB, 54 R, 65 R, 58 R

[56] References Cited

U.S. PATENT DOCUMENTS

| | | | |
|---|---|---|---|
| 435,637 | 9/1890 | Win . | |
| 558,943 | 4/1896 | Gardner . | |
| 588,672 | 8/1897 | Wordsworth et al. . | |
| 637,298 | 11/1899 | Strong . | |
| 1,112,287 | 9/1914 | Gunn . | |
| 1,414,987 | 5/1922 | Loeffler et al. . | |
| 1,419,688 | 6/1922 | Peigler . | |
| 1,429,877 | 9/1922 | Heuser . | |
| 1,606,591 | 11/1926 | Muller . | |
| 1,697,723 | 1/1929 | Gigli . | |
| 1,776,760 | 9/1930 | Barkeij . | |
| 1,885,576 | 11/1932 | Barkeij . | |
| 1,956,804 | 5/1934 | Meyer | 123/54 R |
| 1,956,922 | 5/1934 | Ingram . | |
| 1,998,706 | 4/1935 | Campbell . | |
| 2,014,771 | 9/1935 | Mallory . | |
| 2,130,529 | 9/1938 | Filicky . | |
| 2,234,267 | 3/1941 | Mallory . | |
| 2,351,050 | 6/1944 | Karey . | |
| 2,392,933 | 1/1946 | Mallory . | |
| 2,429,270 | 10/1947 | Mallory . | |
| 2,536,960 | 1/1951 | Sherwood . | |
| 2,909,163 | 10/1959 | Biermann | 123/48 B |
| 3,985,475 | 10/1976 | Gatecliff . | |
| 4,338,892 | 7/1982 | Harshberger . | |
| 4,466,403 | 8/1984 | Menton . | |
| 4,505,239 | 3/1985 | Deland . | |
| 4,708,096 | 11/1987 | Mroz | 123/54 R |

FOREIGN PATENT DOCUMENTS

| | | | |
|---|---|---|---|
| 2855667 | 7/1980 | Fed. Rep. of Germany | 123/54 R |
| 0085528 | 7/1981 | Japan | 123/54 R |
| 0085530 | 7/1981 | Japan | 123/54 R |
| WO82/01913 | 6/1982 | PCT Int'l Appl. | 123/54 R |
| 1133618 | 11/1968 | United Kingdom . | |

OTHER PUBLICATIONS

Arkangelsky et al., "Motor Vehicle Engines", 1971, pp. 361–377, (no month provided).

*Primary Examiner*—David A. Okonsky
*Attorney, Agent, or Firm*—Flehr, Hohbach, Test, Albritton & Herbert

[57] ABSTRACT

An internal combustion engine in which the center line of each cylinder is offset from the rotational axis of the crankshaft in the direction of rotation. The resulting altered piston timing provides earlier effective torque during the power stroke, inherent suppression of premature detonation or knocking, increased volumetric and mechanical efficiency, lower thrust loading on the cylinder walls, and decreased vibration.

13 Claims, 3 Drawing Sheets

ALTERED PISTON TIMING ENGINE

This is a continuation, division, of application Ser. No. 031,475 filed Mar. 26, 1987, now abandoned.

Field of the Invention

The present invention relates to a reciprocating internal combustion engine which incorporates an altered block design and, in particular, an offset between the piston cylinder center line and the crankshaft axis. This altered geometrical relationship provides increased power and torque and decreased vibration. While the description here is keyed to automobile—and truck-type motor vehicle engines, the applicability of my invention is unrestricted as to the number of cylinders and the engine configuration (in-line, V, horizontal opposed, etc.). In addition, my invention applies in general to reciprocating internal combustion engines used in all types of transport vehicles, marine engines, heavy equipment, power plants, compressors, fluid pumps, recreational vehicles, yard maintenance equipment (chain saws, lawn mowers, etc.), aircraft, hobby craft and essentially all other applications where reciprocating internal combustion engines are used.

Background of the Invention

In the past, one of the primary and consistent design goals for internal combustion engines has been to increase power. In the automobile and truck industry, this goal has resulted at least in part from the competitive need to provide, for example, increased acceleration and performance, and increased load hauling ability. Until very recently, in fact until only a few years ago, simple upward scaling of the size and/or capacity of the engine and associated components was a feasible way, and perhaps the easiest way, to achieve this goal. That is, horsepower and torque could be increased simply by increasing piston displacement, carburetor air flow capacity, etc.

However, as a result of the rapid increases in the price of gasoline during the 1970's, plus actual experience with and the future threat of the decreased availability of gasoline, as well as concern over pollution caused by internal combustion motor vehicle engines, increased fuel economy and decreased emissions have become primary design goals and, in fact, have become government-imposed design requirements.

Typically, these conflicting goals and requirements have been achieved by the use of smaller engines of fewer cylinders, the increased use of fuel injection, computer-type control of ignition timing and, in general, by the use of more technologically sophisticated and frequently more complex systems and components.

The recent engine technology developments, including microprocessor-controlled fuel delivery via fuel injection and microprocessor-controlled ignition, along with other developments such as valve systems which use multiple intake/exhaust valves per cylinder, have resulted in the regaining of much of the power and torque which had been lost to CAFE fuel requirements and low emission standards. However, and as is suggested by the above partial listing of technological advances, achieving the requisite fuel efficiency and low emissions and the recovered power and torque has been expensive, a fact which is reflected in the increased cost of today's automobiles and trucks.

Summary of the Invention

In view of the above discussion, it is one object of the present invention to provide a simple, relatively inexpensive improvement in the design of reciprocating internal combustion engines which provides increased volumetric and mechanical efficiency.

It is a related object to provide such an improved engine design which provides increased power.

It is a further related object to provide such an improved engine design which provides increased torque.

It is still another related object to provide such an improved engine design which is characterized by inherently low vibration operation.

It is yet another related object to provide such an improved engine which is characterized by inherently low susceptibility to premature detonation or knock.

It is still another object to provide such an improved engine whose operation is characterized by reduced friction.

Another object is to provide an improved engine design as described above which is additive to existing technology in that the engines incorporating my invention can also use other technological enhancement and benefit from both.

In one aspect, the internal combustion engine which embodies the present invention and incorporates the above as well as other objects, comprises: an internal combustion engine of the type having at least one cylinder and associated piston operably connected via a connecting rod to a rotatable crankshaft for rotating said crankshaft, and having the center line or axis of said cylinder offset from the rotational axis of the crankshaft at least about 2° in the direction of rotation. Preferably, the total piston timing change is within the range 2°-60°. In a working prototype engine, the total piston timing change was 15° and the associated cylinder center line offset was about 7.5°.

In another aspect, my invention is directed to a multiple cylinder internal combustion engine of the type comprising a plurality of cylinders and associated pistons operably connected via connecting rods to a rotatable crankshaft for rotating said crankshaft, in which each cylinder center line is offset from the rotational axis of the crankshaft at least about 2° in the direction of rotation. This altered piston timing configuration is applicable in general to in-line, V-configuration and opposing cylinder engines.

In another aspect, my present invention encompasses an operational method for increasing the performance of an internal combustion engine of the type comprising one or more cylinders and piston operably connected via a connecting rod to a rotatable crankshaft for rotating said crankshaft, and comprises offsetting the longitudinal axis of each cylinder about 2° to 60° relative to the rotational axis of the crankshaft in the direction of rotation.

Brief Description of the Drawings

The above and other aspects of the present invention are described with respect to the following drawings, in which.

Detailed Description of the Invention

Overview

Figure 1:
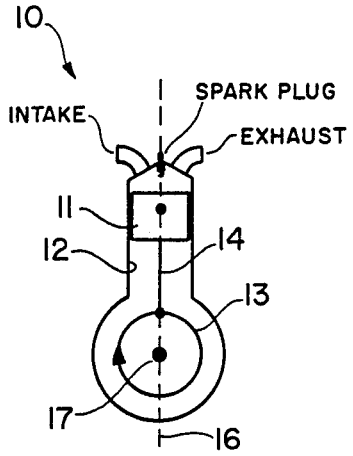
FIG. 1 (PRIOR ART)
FIG. 1 is a simplified schematic representation of a conventional prior art internal combustion engine.

Referring to FIG. 1, there is shown a simplified schematic representation of a prior art engine 10 comprising, in pertinent part, piston 11, cylinder wall 12 of the block, crankshaft 13, and piston connecting rod 14. As shown, the longitudinal axis or center line 16 of the cylinder wall 12 and the piston 15 intersects longitudinal axis of rotation 17 of the crankshaft.

It is know to alter the performance characteristics of engines by increasing or decreasing the length of the connecting rods. The choice between relatively long or relatively short connecting rods involves a trade-off or compromise in that the selected, presumably more critical, operational characteristics are enhanced, but other areas of performance are adversely affected.

Consider first longer connecting rods. Volumetric efficiency can be increased either by increasing the rate of air/fuel flow to the cylinder or by lowering flow demand. In the case of an engine having a longer connecting rod, the increased connecting rod length provides lower piston speeds for a given rpm. As a consequence, the fuel/air flow demand (typically measured in cfm, cubic feet per minute) is decreased and the time available for induction is longer. In short, the lower piston speed lowers the air flow demand In addition, the angle between the connecting rod and the cylinder axis is decreased when the length of the connecting rod is increased, thereby resulting in a smaller component of force being applied against the cylinder wall. As a consequence, cylinder wall friction and loading are decreased.

In contrast, the use of a shorter connecting rod provides a more effective crank radius immediately after top dead center and, thus, a more effective lever arm action and torque. This advantage is referred to here as "earlier torque". However, as suggested above, the use of shorter (or longer) connecting rods involves a compromise, for shorter (longer) connecting rods decrease performance in the above-described areas for which longer (shorter) connecting rods increase performance.

Figure 2:
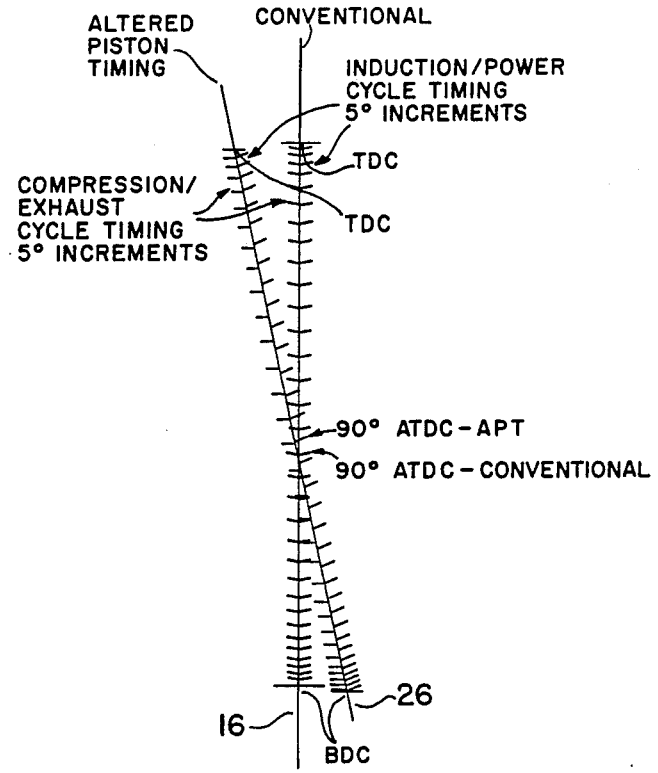
FIG. 2 is a simplified schematic representation of an engine which embodies the altered piston timing design which is my present invention.
Figure 2:
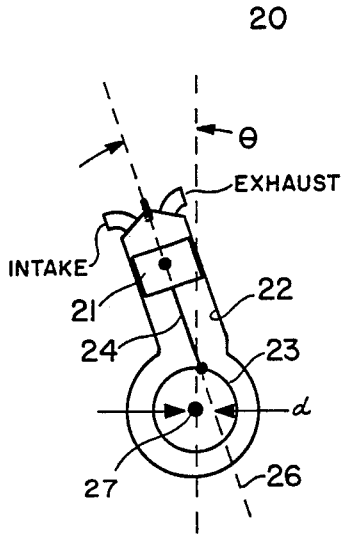
Figure 6:
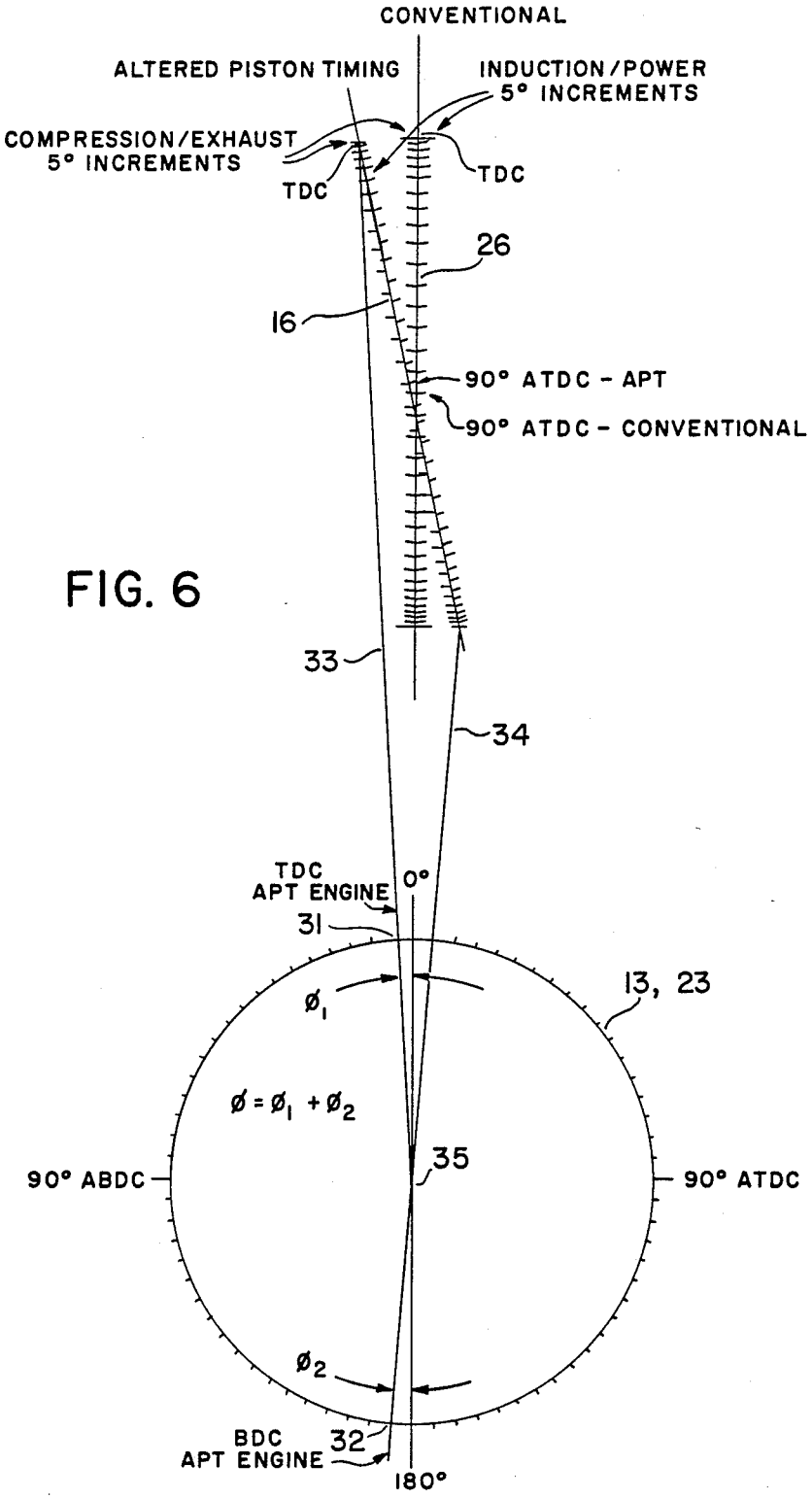
FIG. 6 is a schematic representation of the relationship between piston travel and piston orientation and also depicts measurement of altered piston timing.

Referring to FIG. 2, there is shown a simplified schematic of a preferred embodiment of my internal combustion engine 20, which incorporates altered piston timing (APT). The engine 20 comprises a piston 21, cylinder wall 22, crankshaft 23, and piston connecting rod 24. In contrast to the conventional engine layout shown in FIG. 1, the axis or center line 26 of the cylinder wall 22 and piston 25 of the APT engine 20 is offset relative to the longitudinal axis 27 of the crankshaft. The offset is in the direction of rotation. That is, for the illustrated APT engine 20, which rotates in a clockwise (cw) direction, the offset is also clockwise, to the right. In FIG. 2, the cylinder center line offset distance is denoted "d", while the associated cylinder center line angular offset is denoted "$\theta$". The total altered piston timing $\phi$associated with the cylinder center line offset ($\theta$,d) is shown in FIG. 6, as is a graphical method for measuring $\phi$. Specifically, as shown in FIG. 6, the total piston timing angle change $\phi$ is the sum of the angular offset $\phi_1$ from conventional TDC and the angular offset $\phi_2$from conventional BDC. The offsets $\phi_1$ and $\phi_2$ are determined by the respective intersections 31 and 32 with the crankshaft/connecting rod's path of rotation 13 or 23 of lines 33 and 34 drawn through the center o rotation 35 of the crankshaft.

Figure 3:
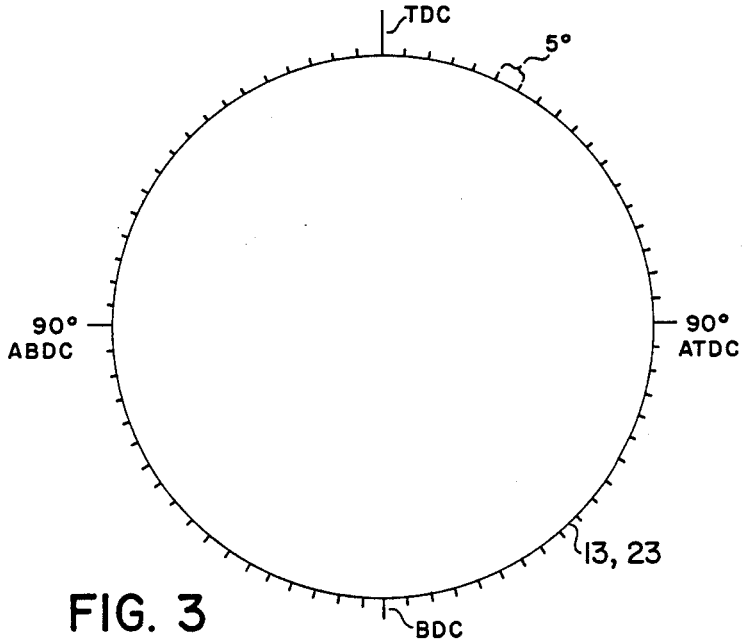
FIG. 3 is a schematic diagrammatic representation of piston travel and piston orientation for the conventional internal combustion engine of FIG. 1 and for my altered piston timing engine 20 of FIG. 2.

The surprising results of this relatively simple physical APT alteration are many. Referring to FIG. 3, there is shown a schematic, diagrammatic representation of piston travel, piston orientation and crankshaft orientation for both the conventional internal combustion engine 10 of FIG. 1 and my APT engine 20. In FIG. 3, each gradation along the cylinder center line axes 16 or 26 represents the piston travel for 5° of rotation of crankshaft 13 or 23. The unique features of the APT engine 20 associated with the APT configuration which is depicted in FIG. 3 include the relatively small angle between the connecting rod and cylinder axis during the power and intake strokes, and the higher than normal piston speed after ignition, as well as the overall lower piston speed during the induction and expansion cyles. The induction and expansion cycles are longer than the exhaust and compression cycles (see also FIG. 4). These factors provide a unique combination of improved performance characteristics. That is, the altered piston timing combines the previously mutually-exclusive advantages of both the longer connecting rod designs (increased volumetric efficiency by virtue of the lower piston speed, and decreased cylinder wall friction and loading) and the shorter connecting rod designs (earlier torque). Additionally, the APT engine 20 provides very low vibration and inherently knock-free operation.

In conventional engines, premature detonation or knock may occur early during the power cycle, at or near TDC. The cylinder pressure is building rapidly because of the ignition of the air/fuel mixture, but the piston is moving too slowly to allow sufficient expansion. For the APT engine 20, it is believed high speeds after ignition result in the better anti-knock capability.

During the induction cycle, and referring again to FIG. 3, upon accelerating a relatively few degrees away from TDC, piston acceleration decreases and, in fact, depending upon the extent of the offset, piston speed may stabilize, thereby lowering the air flow demand and increasing volumetric efficiency. During the power cycle, lower piston speed also allows the pressure build to apply force on the piston without the piston acceleration outrunning the pressure build.

In addition, the smaller connecting rod angles result in lower cylinder wall loading and frictional heat loss, and also provide a corresponding increase in the power transfer to the crankshaft to drive the engine.

Figure 4:
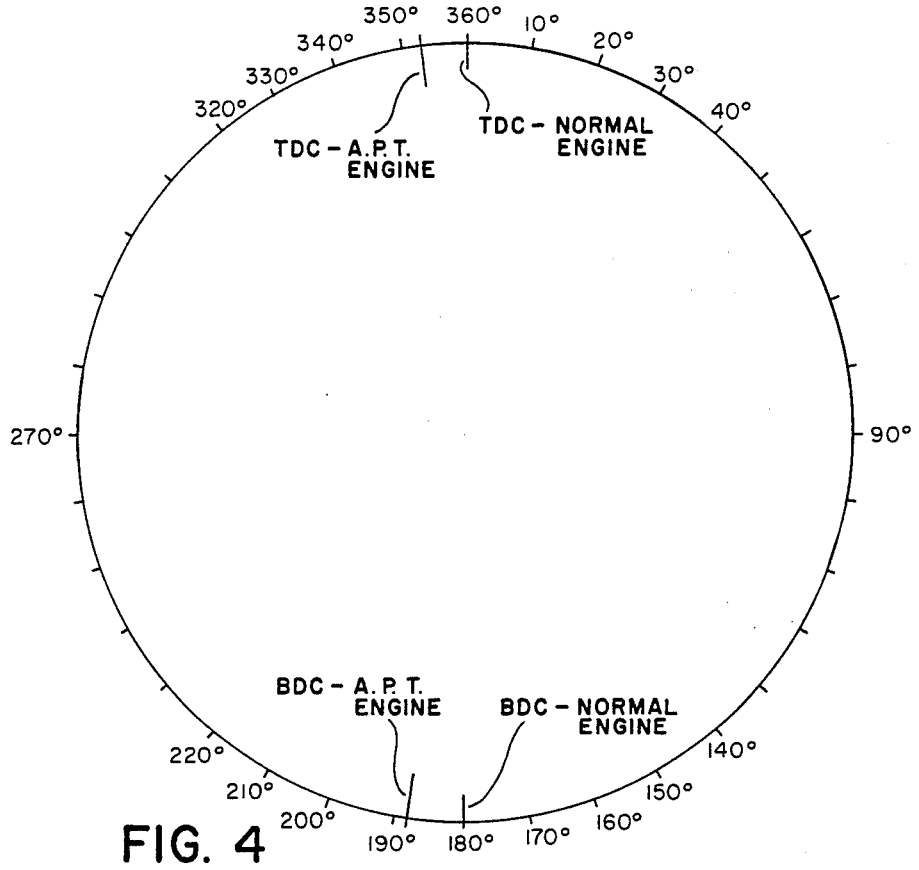
FIG. 4 depicts the increased angular path of the induction and power cycles and the decreased angular path of the compression and exhaust cycles which result from an altered piston timing of 15° and associated cylinder center line offset of 7.5°.

Vibration control has been an unexpected benefit of the altered piston timing. As suggested above, the four-cylinder in-line internal combustion engines which are now widely used for automobile and light trucks typically suffer from torque intermittency and harmonics and, thus, excessive vibration. In the past, various approaches such as five cylinders and extensive external shaft counter-balancing have been used to control vibration. In the APT engine 20, the cylinder offset increases the induction and expansion cycles to more than 180° and decreases the compression and exhaust cycles to less than 180°. Referring to FIG. 4, for an exemplary angular offset $\theta \simeq 7.5°$ (distance offset $d \simeq 0.7$ inches), the induction and power cycles are expanded to cover approximately 194° whereas the compression and exhaust cycles are decreased to about 166°. This is in contrast to a typical four-cylinder, in-line, 180° crankshaft engine in which one piston is at top dead center when another is at bottom dead center. In the APT engine 20, the dwell periods of TDC and BDC overlap with the result that the torque intermittencies also overlap. Consequently, the vibration is much decreased relative to the conventional, non-compensated engine without altered piston timing.

Example

Figure 5:
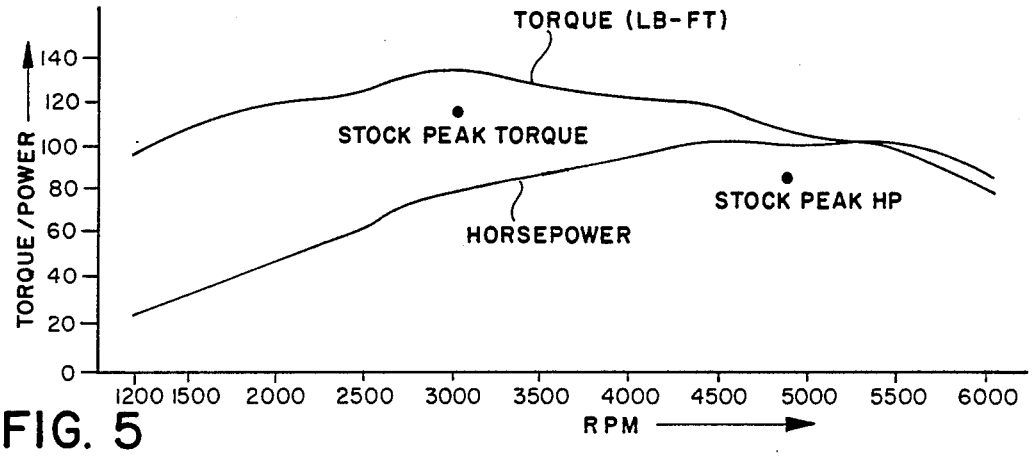
FIG. 5 is a graph of torque and power as a function of rpm for a working embodiment of my APT engine.

The advantages and benefits of my altered piston timing engine were demonstrated using a 1976 Ford 2.3 liter, four-cylinder, in-line, 180° crankshaft engine having approximately 97,000 miles of previous use. The block was rebored and fitted with sleeves to provide an offset $\theta \simeq 7.5°$ and $d \simeq 0.7$ inches for each cylinder in the direction of crankshaft rotation. In an attempt to approximate new engine performance, the engine was also fitted with new pistons, rings, bearings, oil pump and miscellaneous accessory parts. The performance results for this engine are tabulated in Table 1 below and are shown graphically in FIG. 5. The tabulated data was obtained by running the engine at an ambient air temperature of 75° and barometric pressure of 29.8 inches of mercury. Vacuum at idle was 19 inches and oil pressure at idle was 55 pounds. Once the engine warmed up and the coolant temperature reached about 190° F., dynamometer readings of horsepower and torque were taken at the rpm values listed in Table 1.

Table 1 and FIG. 4 also list the Ford Motor Company factory peak or maximum ratings for this engine: 120 foot pounds of torque at 3,000 rpm and 89 horsepower at 4,800 rpm. In contrast, the APT engine 20 provided 134 foot pounds of torque at 3,000 rpm, an increase of 14 foot pounds or about 11.7 percent relative to the peak factory torque rating. In fact, the measured torque exceeded the stock peak or maximum torque rating over an extended range, down to at least about 2,500 rpm. The measured APT horsepower at 4,800 rpm was 98.4, an increase of 9.4 or about 10.6 percent over the factory peak rating. The horsepower of the APT engine exceeded the factory maximum horsepower rating over an extended range, down to at least about 3,700 rpm.

It is believed such factory ratings are typically high by as much as 10 percent. Even assuming precisely accurate factory ratings, the 10.6 percent horsepower increase and 11.7 percent torque increase and the extension of the torque and peak horsepower ranges evidence a quite significant improvement. Furthermore, the factory ratings are obtained using optimum factory ignition timing, etc., and the above APT data were also taken using stock factory timing, which is not optimum for the APT enigine. More recently, I have found that retarding the timing about 5° provides torque and horsepower increases approximately double those indicated in the table and in FIG. 5. In addition, the APT design lends itself, e.g., to crankshaft timing changes and exhaust flow increases which will provide further performance increases.

TABLE 1

| Altered Piston Timing Engine: 1976 2.3 Liter Four-Cylinder Engine | | |
|---|---|---|
| Dynamometer Readings (Using stock ignition timing and crankshaft timing.) | | |
| Speed (rpm) | Power (hp) | Torque (ft lb) |
| 1200 | 21.7 | 95 |
| 1500 | 29.4 | 103 |
| 2000 | 45 | 118 |
| 2500 | 58 | 122 |
| 3000 | 76.5 | 134 (120)* |
| 3500 | 82.6 | 124 |
| 4000 | 91.5 | 120 |
| 4800 | 98.4 (89)* | 108 |
| 5000 | 95.2 | 100 |
| 5500 | 99.5 | 95 |
| 6000 | 85.7 | 75 |
| 7500 | N/A | N/A |
| Test Conditions | | |
| Air temperature | | 75° F. |
| Barometric pressure | | 29.8 |
| Coolant temperature | | 190° F. |
| Vacuum at idle | | 19 inches |
| Oil Pressure at Idle | | 55 lbs. |

*Factory Ratings

The premature detonation/knock characteristics of our APT engine 20 were investigated by warming the engine to about 220° F., running the engine on low octane gas (87 octane rating), and loading down the engine to about 1,500 to 2,000 rpm and below, as measured on the dynamometer. Using this approach, detonation (evidenced by barely audible "pings") was initiated at approximately 60° of ignition timing, which is about 30° greater than is normally used. Based upon this result and additional experience in driving a car fitted with this experimental prototype APT engine 20, it is concluded the APT design suppresses detonation to the extent that it is very difficult to deliberately obtain detonation/knocking.

In addition, experience in driving the car fitted with the prototype APT engine 20 has shown that this engine is exceptionally smooth and vibration-free.

Thus, our prototype engine has demonstrated all of the advantages listed above. In addition because of the increased mechanical efficiency, I expect fuel consumption to be decreased.

It should be noted that the presently used offset of 7.5° is by no means optimum. To date, limited funds have prevented determining the optimum value, even for this present prototype engine. However, given the simple nature of the altered piston timing design, the optimum offset for a particular engine will be readily determined by those of usual skill in the art. It is anticipated that the benefits of altered piston timing will apply to a lesser or greater extent over a range up to about 60° of maximum piston timing change and for piston timing alterations as small as 2° to 3° or less. That is, the presently contemplated maximum range for useful piston timing alteration is about 2° to 60°, and will be determined by rod length, stroke length, block design, cylinder head design and other related parameters.

In summary, my altered piston timing design for reciprocating internal combustion engines provides earlier effective torque during the power stroke, inherent suppression of premature detonation or knocking, increased volumetric and mechanical efficiency, lower thrust loading on the cylinder walls, and decreased vibration.

It should be emphasized that these five areas of improved performance are provided by altered piston timing in which the cylinder axis is offset in the direction of rotation.

Having thus described preferred and alternative embodiments of the present invention what is claimed:

1. A reciprocating internal combustion engine having at least one offset cylinder, each said offset cylinder having an associated piston operably connected via a connecting rod and crank pin to a rotatable crankshaft having a rotational axis for rotating said crankshaft, an imaginary line defined as the axis of an imaginary cylinder when the imaginary cylinder is positioned without an offset such that the imaginary line extends through the crankshaft axis and the crank pin when an imaginary piston in the non-offset imaginary cylinder is at top dead center position, wherein the axis of each and every said offset cylinder is offset from the rotational axis of the crankshaft such that the angle between said imaginary line and the centerline of the connecting rod is at least about 2 degrees counter to the direction of rotation of the crankshaft when the associated piston is in its top dead center position and wherein the centerline of the connecting rod is parallel or coincident with the offset cylinder axis at two positions in the crankshaft rotation that are seperated by at least five degrees of crankshaft rotation.

2. The internal combustion engine of claim 1, wherein the offset for each said offset cylinder is within the range of about 2°-60°.

3. The internal combustion engine of claim 1 wherein the offset is approximately 15°.

4. A multiple cylinder internal combustion engine comprising:

a rotatable crankshaft having an axis of rotation;

a plurality of offset cylinders each said offset cylinder having a longitudinal axis;

a plurality of associated pistons each said piston being associated with a particular one of said offset cylinders for axial movement therein between a top position and a bottom position;

a plurality of connecting rods each operably connecting a particular piston to the rotatable crankshaft for rotating said crankshaft, each said connecting rod being coupled to its associated piston at a piston pin pivot point and the crankshaft at a crankshaft pivot point, and having a rod axis extending between the piston pin pivot point and the crankshaft pivot point, an imaginary plane including the axes of each of imaginery cylinders when positioned without an offset such that the imaginary plane extends through the axis of rotation of the crankshaft and the respective crankshaft pivot points when the respective imaginary pistons in the non-offset imaginary cylinders are at top dead center positions, wherein the axis of each and every offset cylinder is offset from the rotational axis of the crankshaft such that the angle between the imaginary plane and the rod axis is greater than about 2° counter to the direction of rotation of the crankshaft when the assoicated piston is in its top position and wherein the rod axis is parallel or coicident with the longitudinal axis of the offset cylinder at two positions in the crankshaft's rotation that are separated by at least five degrees of crankshaft rotation.

5. The internal combustion engine of claim 4, wherein the offset is in the range 2°-60 °.

6. The internal combustion engine of claim 4, wherein the offset is approximately 15 °.

7. The internal combustion engine of claim 4, 5 or 6, wherein the engine is of an in-line configuration.

8. The internal combustion engine of claim 7, wherein the engine configuration is selected from four, five and six cylinders.

9. The internal combustion engine of claim 4, 5 or 6, wherein the engine is of a V configuration.

10. The internal combustion engine of claim 9, wherein the engine configuration is selected from six, eight and twelve cylinders.

11. The internal combustion engine of claim 4, 5 or 6, wherein the engine is of a horizontal opposed configuration.

12. The internal combustion engine of claim 11, wherein the engine configuration is selected from four and six cylinders.

13. An operational method for increasing the performance of a reciproacating internal combustion engine comprising at least one offset cylinder and an associated piston operably connected via a connecting rod to a rotatable crankshaft for rotating said crankshaft and an imaginary line defined as the axis of an imaginary cylinder when positioned without an offset such that the imaginary line extends through the crank axis and the crank pin when an imaginary piston in the non-offset imaginary cylinder is at top dead center position, comprising offsetting the center line of each and every offset cylinder from the rotational axis of the crankshaft such that the angle between said imaginary line and the centerline of the connecting rod is at least about 2° counter to the direction of rotation of the crankshaft when the associated piston is in its top dead center position, and wherein the centerline of the connecting rod is parallel or coincident with the offset cylinder axis at two positions in the crankshaft rotation that are separated by at least five degrees of crankshaft rotation.

* * * * *